United States Patent [19]

Fox

[11] Patent Number: 4,881,736

[45] Date of Patent: Nov. 21, 1989

[54] BAT HANDLE FOR PLASTIC BEVERAGE BOTTLE

[76] Inventor: Daniel W. Fox, 202 East Sharon, Phoenix, Ariz. 85022

[21] Appl. No.: 530,090

[22] Filed: Sep. 7, 1983

[51] Int. Cl.[4] ..... A63B 59/00

[52] U.S. Cl. ..... 273/26 B; 273/67 DA

[58] Field of Search ..... 273/26 R, 26 B, 72 R, 273/67 DA, 193 B, 81.2, 72 A, 75, 73 J, 80 R, 80.1, 80.7, 143, 67 DB, 73 D; 46/11; 272/123, 122; D8/11

[56] References Cited

U.S. PATENT DOCUMENTS

| | | | |
|---|---|---|---|
| 259,752 | 6/1882 | Fischer Jr. | 272/122 |
| 3,246,894 | 4/1966 | Salisbury | 273/26 B |
| 3,796,431 | 3/1974 | Sinyard | 272/122 |
| 3,848,737 | 11/1974 | Kenon | 273/80.1 |
| 3,955,816 | 5/1976 | Bratt | 273/72 |
| 3,967,822 | 7/1976 | Candor et al. | 273/26 R |
| 4,006,900 | 2/1977 | DiVito | 273/26 B |

FOREIGN PATENT DOCUMENTS

| | | | |
|---|---|---|---|
| 456791 | 3/1928 | France | 272/123 |
| 17640 | of 1900 | United Kingdom | 272/122 |
| 325427 | 2/1930 | United Kingdom | 273/73 D |

*Primary Examiner*—T. Brown

*Attorney, Agent, or Firm*—Fleit, Jacobson, Cohn, Price, Holman & Stern

[57] ABSTRACT

A bat handle for attachment to plastic bottles or containers in the form of an elongated tubular plastic handle having an internally threaded tubular end portion for threaded engagement with the threads normally provided on the neck of a plastic beverage bottle or other similar bottles or containers to form a combination bat handle and bottle that can be used in the nature of a baseball bat, softball or the like so that children may use the combination handle and bottle as a toy bat for batting lightweight balls such as hollow plastic or rubber balls with or without apertures in the periphery thereof, foam plastic balls, sponge rubber balls, inflated balls and the like. The bat handle is simulative in color, shape and apearance to an actual bat handle and includes a knob on the end thereof remote from the internally threaded end portion. The knob end of the bat handle is provided with a concave recess by which the combination may be used as a batting tee with the flat bottom of the beverage bottle or container stablizing the combination on a supporting surface so that a ball may be held stationarily and in an elevated position for striking with another bat. By providing screw threaded internal end portions on each end of the hollow handle, two plastic bottles may be connected together in alignment for use as a toy baton, dumbbells and the like.

6 Claims, 1 Drawing Sheet

BAT HANDLE FOR PLASTIC BEVERAGE BOTTLE

BACKGROUND OF THE INVENTION

1. Field of the Invention

The present invention generally relates to a toy, amusement device, exercising device or the like, especially adapted for use by children and is in the form of a promotional item by which existing throw-away containers such as plastic bottles containing various types of beverages can be utilized as a utilitarian item. More specifically, the present invention relates to a bat handle, simulative of an actual bat handle, constructed of plastic or similar material and provided with an internally threaded tubular end portion in which the threads match the threads on the neck of a plastic beverage bottle so that after the contents of the bottle have been consumed or removed, the bat handle can be securely threaded onto the threaded neck of the bottle and the combination bottle and bat handle can then be used as a bat for batting various types of balls, especially lightweight balls. The bat handle includes a concave end on the knob end thereof so that the combination bottle and bat handle may be used as a batting tee to support a ball in stationary elevated position so thatit can be struck with another bat. Also, the bat handle may be constructed withboth ends provided with tubular threaded internal threads for connecting two bottles together in alignment for use as a toy baton, dumbbells and the like.

2. Description of the Prior Art

Various types of toy bats, balls and the like have been provided including tubular hollow plastic bats for use with lightweight hollow plastic or rubber balls or lightweight solid but resilient foam plastic or sponge rubber balls. Such bats and balls are especially useful by small children who are learning to swing a bat and are unable to effectively handle a conventional wood bat. Also, conventional wood bats and softballs or baseballs sometimes are misused by small children which can result in injury to themselves, playmates or damage to other objects which may be indiscriminately struck by a wooden bat. Various other types of ball practicing devices are well known such as tethered balls, ball supporting tees and other practicing aids for teaching children rudimentary skills with respect to hitting a ball with a bat.

SUMMARY OF THE INVENTION

An object of the present invention is to provide a bat handle for attachment to a plastic beverage bottle having a threaded neck with the bat handle including an internally threaded tubular end portion for screw threaded engagement with and attachment to the neck of a plastic bottle after the contents of the bottle have been consumed or removed thereby providing a combination bat handle and container which may be used in the nature of a conventional bat to strike a lightweight ball.

Another object of the invention is to provide a bat handle in the form of an elongated plastic member generally of circular cross-sectional configuration that is simulative of an actual bat handle and includes a knob at one end thereof and an internally screw threaded socket or tubular end portion at the other end thereof for secure screw threaded engagement with the neck of a plastic beverage bottle such as a two liter plastic bottle in which consumable beverages are normally supplied so that after the beverages have been consumed, the bat handle may be attached to the bottle for its use as a bat thereby providing an entertaining toy or amusement device and also an exercising device which primarily is in the form of a promotional item with the bat handle being provided as a bonus accompanying the beverage when it is purchased or as a premium item which may be obtained by the purchaser forwarding a coupon and possibly proof of purchase to the supplier of the beverage thereby converting the normally discardable plastic beverage bottle into a utilitarian item.

A still further object of the invention is to provide a bat handle in accordance with the preceding objects in which the knob end of the bat handle is provided with a concave recess to support a ball in elevated position with the bat handle and bottle to which it is attached forming a tee for supporting the ball in stationary elevated position thereby enabling the ball to be struck by a child swinging another bat.

Still another object of the invention is to provide a bat handle in accordance with the preceding objects in which the bat handle may be provided with internally threaded sockets at each end thereof for connecting two plastic beverage bottles together for use as a toy baton, dumbbells or the like.

A still further object of the invention is to provide a bat handle in accordance with the preceding objects which is inexpensive to manufacture, easily and securely attached to a plastic bottle and produces a safe and highly effective bat with the plastic bottle providing a relatively large area for engagement with a ball.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
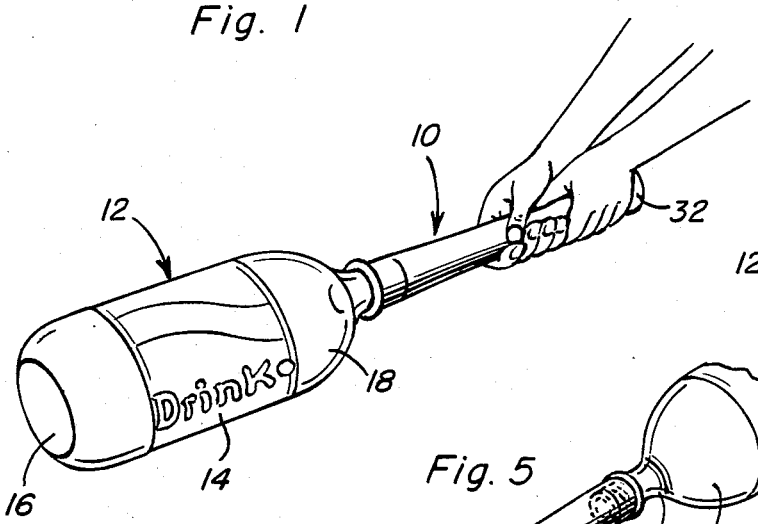
FIG. 1 is a perspective view of the combination bat handle and plastic beverage container forming a bat which can be used to strike a ball in various conventional manners.
Figure 2:
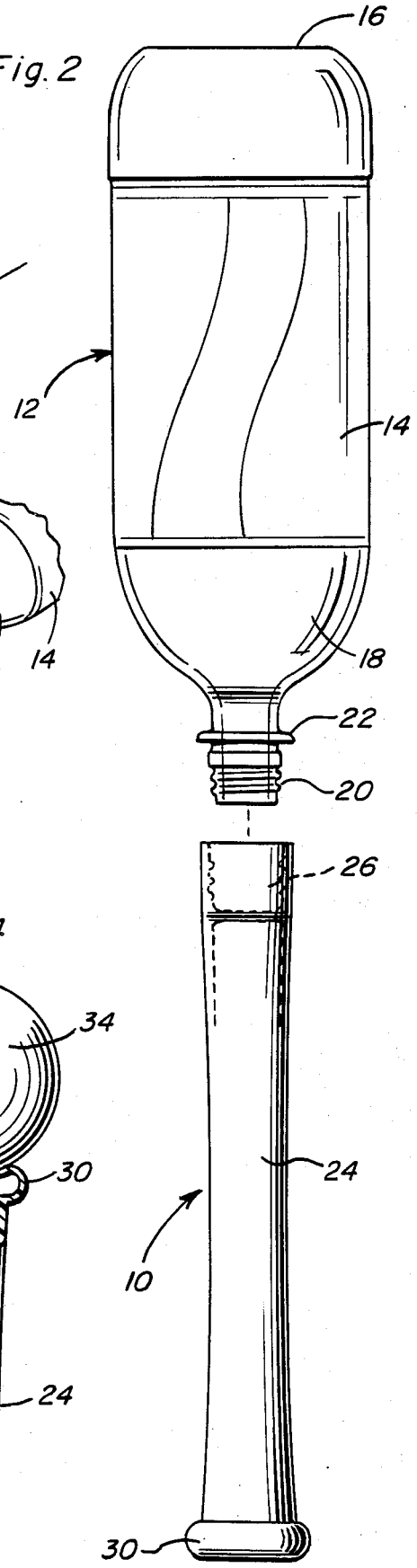
FIG. 2 is a side elevational view of the bat handle and plastic bottle illustrating the manner in which they are to be connected.

The bat handle of the present invention is generally designated by reference numeral 10 and is used in associated with a plastic beverage bottle such as a two liter plastic bottle generally designated by the numeral 12 such as those conventionally employed for soft drinks, carbonated beverages, and other similar beverages and which are conventional in nature and provided with a generally elongated cylindrical body 14 with a generally flat base end 16 and an inwardly curving upper end 18 terminating in an externally threaded neck 20 having a flange 22 at the inner end of the threaded portion. The threaded neck 20 normally includes a closure cap screw threaded thereon and sealed thereto so that when the cap is unscrewed, the seal is broken. Bottles of this type are normally discarded after the beverage or other contents thereof have been consumed or removed and proper disposal of such containers produces disposal problems at solid waste disposal facilities. By attaching the bat handle 10 to the bottle 12, the plastic beverage bottle 12 may then be used as a utilitarian item, such as a toy bat or the like, for use by small children.

Figure 3:
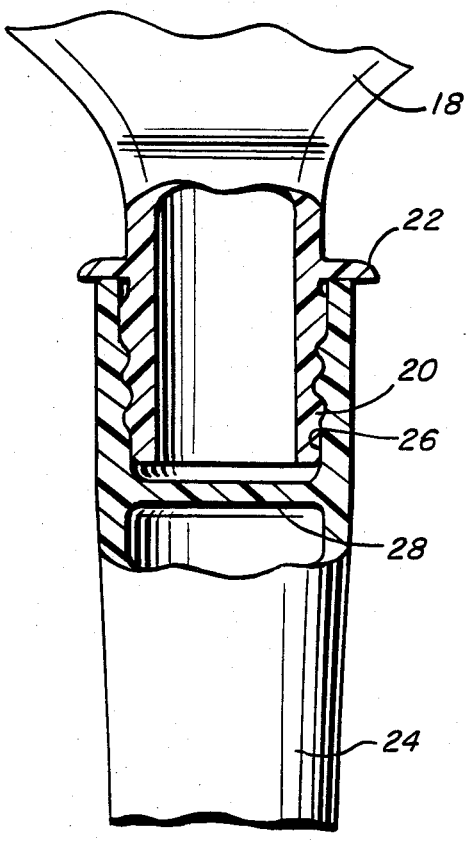
FIG. 3 is a sectional view, on an enlarged scale, illustrating the connection between the bat handle and plastic beverage bottle.

The bat handle 10 is an elongated tubular plastic member 24 having an external shape and configuration simulative of an actual baseball bat handle. One end of the tubular member 24 is provided with an internally socket 26 having threads therein matching the threads on the neck 20 of the plastic bottle 12 so that the bat handle 10 may be easily attached to the plastic bottle 12 in the manner illustrated in FIG. 3 with the terminal flat end of the tubular member 24 engaging the normally provided flange 22 on the plastic bottle 12. The usual cap and retaining ring attached thereto are removed from the bottle and thrown away or in some instances, the metal retaining ring may be left in place and only the metal cap discarded. As a reinforcement to the tubular handle 24, a partition 28 may be provided at the inner end of the socket 26. At the other end of the tubular member 24, a peripheral rounded knob 30 is provided which is simulative of the knob on an actual baseball bat. Also, the end of the tubular member 24 having the knob thereon is provided with a concave indentation or recess 32 which will fit and supportingly engage a portion of the periphery of a ball 34 which enables the plastic bottle 12 and bat handle 10 to be used as a tee to support the ball 34 in an elevated position so that it can be struck by another bat.

FIG. 1 illustrates the manner of using the bat handle 10 and plastic beverage bottle 12 when assembled with it being pointed out that the dimensions of the plastic beverage bottle 12 are such as to provide a large area which may be used to strike a ball such a hollow, plastic or rubber ball of rigid or resilient characteristics as well as solid foam, plastic or sponge rubber balls, all of which are relatively lightweight. The shape and configuration of the bat handle 10 is closely simulative of an actual bat handle in order for a small child to become acquainted with the feel, shape, configuration and weight of an actual bat while providing a safe and easily handled and used bat to enable a small child to obtain satisfaction from actually striking a thrown ball or striking a ball which may be laying on a grass surface, floor or other supporting surface, thereby providing satisfying entertainment, amusement, exercise and skill training for children while at the same time providing a utilitarian purpose for normally discarded plastic beverage bottles.

Figure 5:
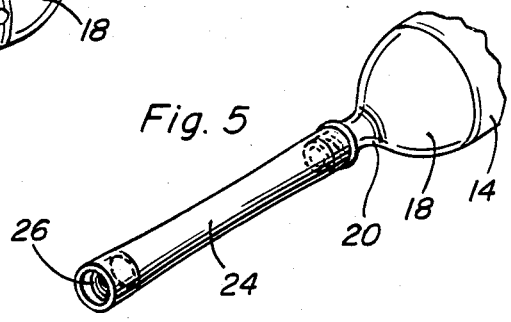
FIG. 5 is a perspective view of a modified form of the bat handle in which both ends thereof have internally threaded tubular end portions for connecting two plastic beverage bottles for use as a toy baton or dumbbells.
Figure 4:
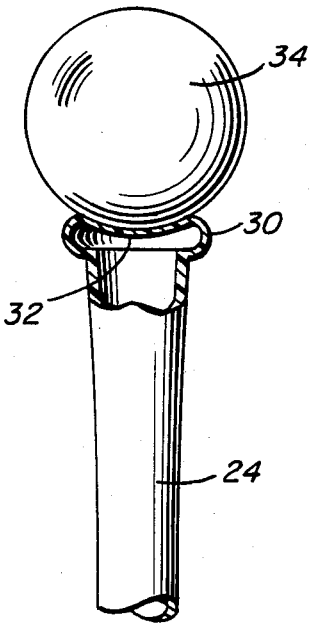
FIG. 4 is a fragmental sectional view of the knob end of the bat handle illustrating its use as a supporting tee for a ball.

While the bat handle is primarily intended as a promotional item for use with plastic beverage bottles of two liter size, the bat handle may be used with other sizes of bottles and containers for other products providing such containers are symmetrical about a longitudinal axis and do not have protruding handles or the like. Also, as illustrated in FIG. 5, the bat handle may be constructed with an internally threaded socket 26 on each end thereof so that two plastic bottles 12 may be interconnected by the bat handle for use as a toy baton or toy dumbbells in which event the plastic bottles may even be provided with granular weight material, liquid weight material or the like for use as exercising devices by small children. The bat handle with the double threaded end may have a knob at one end with the periphery of the internal threaded portion forming a concave area with the knob to support the ball in the same manner as illustrated in FIG. 4 for use as a batting tee so that the bat handle may be used optionally with one or two plastic bottles and be used as a bat handle or as a batting tee or as a connecting handle between two plastic bottles for use as a toy baton or dumbbell.

The bat handle 10 is constructed of plastic materials and may be formed in a conventional manner with the plastic material having substantial rigidity so that it will effectively enable manipulation of the combination bat handle and bottle when striking a ball. The tubular hollow plastic construction enables the bat handle to be constructed so that it is quite light in weight and inexpensive to manufacture thereby enhancing its use as a promotional item. The external surface of the bat handle may closely simulate an actual bat handle and may include wood grain coloration and may be provided with spirally wrapped tape if desired in order to more closely simulate actual bat handles of various types. Also, the bat handle may have indicia imprinted or otherwise formed thereon including simulated signatures of baseball players, trademarks or logos of the beverage company which supplies the bats, trademarks or logos of the manufacturer of the bat or simulated trademarks or logos of conventional well known bat manufacturers depending upon the promotional details of distribution of the bat handle.

The ball 34 may be a lightweight inflatable ball, similar to a beach ball, which is the same size as a blow molded baseball or softball. This type of ball may be easily constructed of multiple colors, advertising indicia, trademarks, logos or other similar material.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bat handle for attachment to the screw threaded neck of a plastic container such as a plastic beverage bottle comprising an elongated member constructed in a manner to simulate the handle of a ball bat, said member including an internally threaded socket on one end thereof for screw threaded attachment to the neck of a container with the container adapted to form an extension of the elongated member and the combination of the elongated member and container adapted to form a bat by which a ball may be struck, said elongated member being an elongated tubular plastic member with the internally threaded socket being of one-piece unitary construction therewith, said elongated tubular member including a peripheral knob at the end thereof remote from the internally threaded socket to prevent the bat handle from slipping out of the hands of a user when a combined bat handle and container are swung in a manner to bat a ball, said knob end of the elongated member being provided with a concave end surface to supportingly engage a portion of the periphery of a ball thereby enabling a combined bat handle and container to serve as a batting tee for supporting a ball in elevated position for engagement by another bat.

2. The structure as defined in claim 1 wherein said elongated tubular member includes a transverse partition defining the inner end of the socket and reinforcing the tubular member.

3. A bat assembly comprising a hollow plastic beverage bottle of generally cylindrical configuration and provided with a reduced, externally threaded neck from which the contents have been consumed or removed and an elongated handle having a diameter less than the bottle and an internally threaded socket on one end thereof in threaded engagement with the neck of the bottle to provide a handle for the bottle extending longitudinally thereof thereby forming a bat assembly having the large diameter generally cylindrical surface of the bottle extending over a substantial portion of the total length thereof.

4. The combination as defined in claim 3 wherein said handle is constructed of lightweight plastic material having a hollow interior, said threaded neck on the bottle normally receiving a screw threaded closure cap which is discarded after the beverage in the bottle has been removed, said handle including a knob on the end thereof remote from the threaded socket, said knob projecting peripherally of the handle to prevent the handle from slipping out of the hands of a user when swung in a manner to bat a ball.

5. The combination as defined in claim 4 wherein the bottle has a generally flat end remote from the neck for stable support on a surface, said knob end of the handle including a concave end surface to supportingly engage a portion of the periphery of a ball thereby serving as a batting tee for supporting a ball in elevated position.

6. The combination as defined in claim 5 wherein said handle includes a transverse partition adjacent the threaded socket to reinforce the socket and define the inner end of the socket, said bottle having an abutment flange on the neck at the inner end of the threads for engagement with the socket end of the handle.

* * * * *